United States Patent [19]

Choi

[11] Patent Number: 4,982,133

[45] Date of Patent: Jan. 1, 1991

[54] DISPENSER CATHODE AND MANUFACTURING METHOD THEREFOR

[75] Inventor: Jong-seo Choi, Hwasung, Rep. of Korea

[73] Assignee: Samsung Electron Device Co., Ltd., Rep. of Korea

[21] Appl. No.: 431,248

[22] Filed: Nov. 3, 1989

[30] Foreign Application Priority Data

Nov. 11, 1988 [KR] Rep. of Korea ..... 88-14856

[51] Int. Cl.[5] ..... H01J 19/06

[52] U.S. Cl. ..... 313/346 DC

[58] Field of Search ..... 313/346 R, 346 DC; 445/50, 51

[56] References Cited

U.S. PATENT DOCUMENTS 4,310,603 1/1982 Falce ..... 313/346 DC X
4,594,220 6/1986 Haskes et al. ..... 313/346 R X
4,671,777 6/1987 van Esdonk et al. ... 313/346 DC X
4,737,679 4/1988 Yamamoto et al. ..... 313/346 R
4,823,044 4/1989 Falce ..... 313/346 R X

*Primary Examiner*—Sandra L. O'Shea
*Attorney, Agent, or Firm*—Leydig, Voit & Mayer

[57] ABSTRACT

A cavity reservoir type dispenser cathode includes a first pellet, a second pellet, a cup and a sleeve, the first pellet being made by sintering a mixture of at least one metal selected from among W, Mo, Ta and alloys thereof, at least one metal selected from among Os, Ir, Ru, Re and alloys thereof, and $Sc_2O_3$, the second pellet being made of a mixture of barium-calcium aluminate and $In_2O_3$, the first and second pellets being inserted into a cup and the cup being inserted into and welded to a sleeve. The cavity reservoir type dispenser cathode of the present invention has a high saturation current density at lowered temperatures to prevent deformations and shortening of life expectancy of nearby components due to a high operating temperature.

4 Claims, 2 Drawing Sheets

DISPENSER CATHODE AND MANUFACTURING METHOD THEREFOR

FIELD OF THE INVENTION

The present invention relates to a cavity reservoir type dispenser cathode and a manufacturing method therefor for use in electronic tubes such as cathode ray tubes and iconoscopes.

BACKGROUND OF THE INVENTION

The dispenser cathode may be divided into two types, the impregnation type and the cavity reservoir type. The impregnation type dispenser cathode includes an electron releasing substance, such as an alkaline rare earth compound, in the cavities of a porous metal substrate, while, in the cavity reservoir type cathode, the porous metal substrate and electron releasing substance fill a cup in a stratified form.

The electron releasing material used in the dispenser cathodes is mainly a compound prepared by mixing MgO, SrO, $Sc_2O_3$ and rare earth metallic oxide with, as the chief ingredient, BaO or Ba. Ca. aluminate obtained by sintering BaO, CaO and $Al_2O_3$.

The materials preferable for the porous metal substrate are powders of W, Mo, Ir, Re, Os, Ru or powders of alloys thereof which have high melting point, antiionization and antishock characteristics. The manufacturing process for the porous metal substrate of the dispenser cathode as explained above includes a step of forming it by means of a press jig, a step of sintering it under an atmosphere of hydrogen gas or a vacuum, and a step of impregnating into it an electron releasing material.

The dispenser cathode as described above is capable of a high thermal electron releasing state for a long time, is applicable to electron tubes for to diversified purposes, and the research for its improvements and being currently carried out very intensively.

However, such a conventional dispenser cathode is operable at a temperature range of 1050°-1200° C., and its operability only at the high temperature imposes various limitations on designing the components. That is, a heater having a thermal capacity larger than that of the general oxide cathodes has to be provided, and the nearby components such as cup and sleeve have to be made of a heat resistant metal. Further, there are the problems that the electron releasing material within the cavities of the porous metal substrate can be evaporated upon being heated to a high temperature during operation, shortening its life expectancy and that the evaporated electron releasing material can adhere to nearby components, degrading the performance of the electron tube An improved impregnation type cathode intended to lower its operating temperature has been proposed, and this dispenser cathode is manufactured by coating a thin layer of Os,Os alloy or Ir on the thermal electron releasing face of the porous metal substrate. In this cathode, while the operating temperature is lowered by about 150° C., there is the problem that the coated layer is weak against ion impacts, and thus the life expectancy of the cathode is shortened. (Refer to U.S. Pat. No. 4,417,173).

There has been another proposal for the impregnation type cathode in which Sc ingredient is added to the porous metal substrate containing W as the chief ingredient or the surface of the porous metal layer substrate is coated with a W and $Sc_2O_3$ layer, but this dispenser cathode has not been able to attain to a satisfactory level yet. (Refer to U.S. Pat. No. 4,783,613)

There has been a proposal for the cavity reservoir type cathode as shown in FIG. 1, in which a first pellet 1 made of a mixture of barium calcium aluminate and W is inserted into a reservoir 2 secured at the upper position of a sleeve 4, and a second pellet 3 made of W or alloys thereof seals the sleeve 4, this dispenser cathode being disclosed in U.S. Pat. No. 4,823,044. The operating temperature of this dispenser cathode is 850°-1000° C. which is higher by over 150° C. than the operating temperature ($\approx$ 750° C.) of the oxide type cathode, and therefore, there remain the limitation of the design and other disadvantages, although there are some differences.

SUMMARY OF THE INVENTION

Therefore, it is an object of the present invention to provide a cavity reservoir type dispenser cathode in which the manufacturing is simplified and the life expectancy is extended, as well as being operable at operating temperature of the oxide cathode.

It is another object of the present invention to provide a most suitable method for manufacturing the dispenser cathode accomplishing the first object of the present invention.

In achieving the first object, the cavity reservoir type dispenser cathode of the present invention comprises: a first pellet obtained by forming and sintering a mixture of $Sc_2O_3$ and at least one metal powder selected among W, Mo, Ta and alloys thereof and at least one metal powder selected among Os, Ir, Ru, Re and alloys thereof;

a second pellet obtained by forming the mixture of Ba, Ca, Aluminate and $In_2O_3$;

a cup accommodating and securing the first and second pellets; and a sleeve supporting the cup.

In achieving the second object, the manufacturing method according to the present invention comprises:

forming a first pellet by pulverizing to a particle size of 2-3 μm at least one metal selected from among Os, Ir, Ru, Re and alloys thereof, by pulverizing to a particle size of 3-8 μm at least one metal selected from among W, Mo and Ta, by mixing the two kinds of metals with $Sc_2O_3$, by press-forming the resultant mixture, by baking it within a vacuum, and by heat-sintering it under an atmosphere of hydrogen or in vacuum, the first pellet thus obtained being porous;

forming a second pellet by mixing barium calcium aluminate and $In_2O_3$, and by compressing the mixture with a water-insoluble binder; and inserting the first and second pellets into a cup, welding them to the cup, and welding the cup to a sleeve.

BRIEF DESCRIPTION OF THE DRAWINGS

The above objects and other advantages of the present invention will become more apparent by describing the preferred embodiment of the present invention with reference to the attached drawings in which.

DESCRIPTION OF THE PREFERRED EMBODIMENT

The dispenser cathode and the manufacturing method for it according to the present invention will be described referring to FIGS. 2 to 4.

Figure 1:
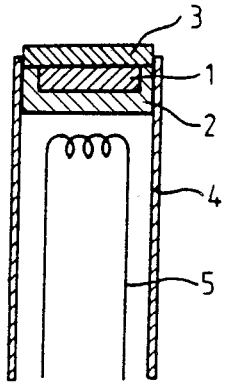
FIG.1(Prior Art)
FIG. 1 is a sectional view of a conventional cavity reservoir type dispenser cathode.
Figure 2:
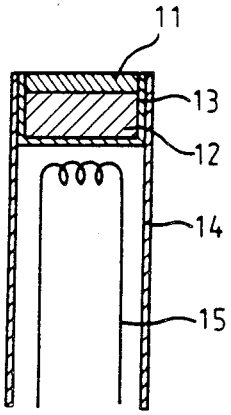
FIG. 2 is a sectional view of the dispenser cathode according to the preferred embodiment of the present invention.

FIG. 2 is a sectional view of the dispenser cathode according to the present invention.

Reference numeral 11 indicates a first pellet which is made by forming and sintering a mixture of at least one metal selected from among Os, Ir, Ru, Re and alloys thereof and at least one metal selected from among W, Mo, Ta and a alloys thereof and proper quantity of $Sc_2O_3$.

Reference numeral 12 indicates a second pellet which is formed by mixing barium calcium aluminate and $In_2O_3$. Reference numeral 13 indicates a cup made of W, Mo or Ta and accommodating and securing the first and second pellets 11, 12, while reference numeral 14 indicates a sleeve made of W, Mo or Ta for supporting the cup 13 which accommodates the first and second pellets 11, 12. Reference numeral 15 indicates a heater made of W-3%Re and coated with $Al_2O_3$ and for releasing thermal electrons by heating the first and second pellets 11, 12.

The cavity reservoir type dispenser cathode of the present invention constituted as above will now be described as to its manufacturing method.

W powders having a particle size of 3–8μm and $Sc_2O_3$ powders having a particle size of 2–3μm are measured to proper amounts, such that the ratio between the $Sc_2O_3$ powders and the W powders is 1–16 wt%. The W powders and the $Sc_2O_3$ powders are sufficiently mixed together, the mixture is press-formed by inserting into a press jig of a circular tube type, a baking is carried out in a vacuum at a temperature of 1000°–1300° C., heating is carried out at a temperature of 1700°–2000° C. under an atmosphere of in a hydrogen or vacuum, and sintering is carried out for 30 minutes or 1 hour, thereupon obtaining the first pellet 11, a porous metal substrate having a porosity of 15–30%.

Here, in consideration of the price and characteristics, the $Sc_2O_3$ powders should be preferably contained in the amount of 16 wt% which is less than 50% of the porous metal substrate in volume. If a more marked effect is required, the $Sc_2O_3$ powder may be contained in the amount of about 1 wt% which is more than 20% in volume. Further, $Sc_2O_3$ may be used mixed with at least one metal selected from among Os, Ir, Ru, Re and alloys thereof, while Mo or Ta powders may be used instead of W powders.

The second pellet 12 is manufactured in such a manner that $In_2O_3$ in the amount of 20~50% is mixed with barium calcium aluminate, the mixture is put into a press jig of a circular tube type, and a pressure of 1~10 t/cm$^2$ is applied to obtain the final component. The circular press jig has to have an inside diameter the same as the diameter of the first pellet 11, and in using this press jig, no water is used as the medium, but a water-insoluble binder such as phenol resin is used.

The first and second pellets manufactured in the manner described above are inserted into the U shaped cup 13 made of W, Mo or Ta, and the side of the first pellet 11 and the cup 13 are fixed to each other by laser welding or electric welding. Then the cup 13 is fitted into the upper portion of the sleeve 14 made of W, Mo or Ta, and secured by means of laser welding or electric welding, while the heater 15 made of W-3%Re and coated with $Al_2O_3$ is installed in the interior of the sleeve 14.

In this dispenser cathode manufactured as described above, the $In_2O_3$ mixed in the second pellet contributes to the production of free Ba. The free Ba thus produced migrates through the cavities of the first pellet 11 to reach the surface of the first pellet 11, i.e., the electron releasing face, where they form a mono-molecular layer expressed in the form of Ba-Sc-O. This mono-molecular layer will greatly lower the work function, with the result that thermal electrons can be released even under a low energy state.

Figure 3:
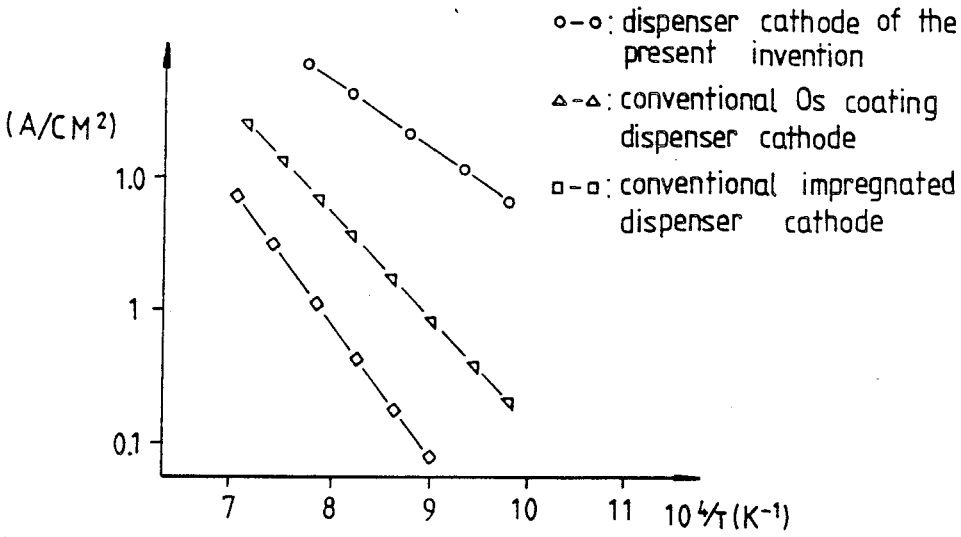
FIG. 3 is a graphical illustration showing a comparison of the saturated current densities of the dispenser cathode of the present invention, the conventional impregnation type cathode and the Os-coated impregnation type cathode.

The characteristics of the saturation current densities for the dispenser cathode of the present invention as described above for a conventional impregnation type cathode and for an Os coated impregnation type cathode are, graphically illustrated in FIG. 3, were measured by means of a pulse type bipolar tube. As can be seen in the curves of FIG. 3, the dispenser cathode according to the present invention has a saturation current density of 10 A/cm$^2$ within the temperature range of 750°~800° C., and can be operated at lower temperature by about 150°~200° C. than that for the conventional Os coated impreganation type cathode.

Figure 4:
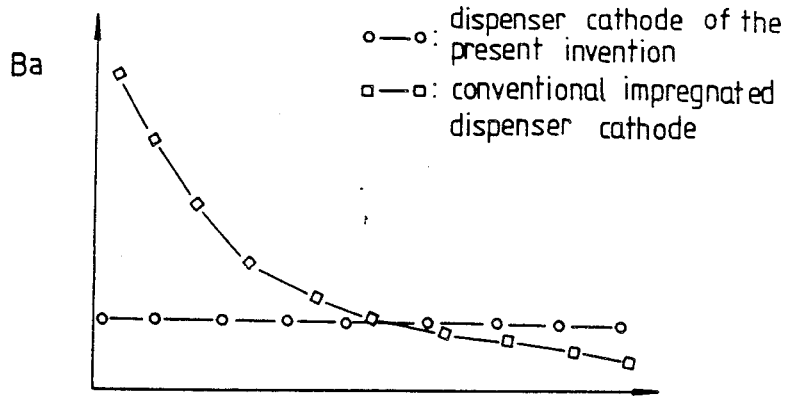
FIG. 4 is a graphical illustration showing the Ba evaporation ratios for the dispenser cathode of the present invention and the conventional impregnation type cathode.

The Ba evaporation ratios for the dispenser cathode of the present invention and the conventional impregnation type cathode were measured, and the results are graphically shown in FIG. 4. As apparent from FIG. 4, the Ba evaporation ratio for the dispenser cathode of the present invention is uniform and stable.

As described above, the dispenser cathode according to the present invention has a high saturation current density characteristic, about 10 A/cm$^2$ in a relatively low temperature range of 750°~800° C., and therefore, the deformations and shortening of the life expectancy of nearby components due to high temperature operation can be eliminated. Further, the same heater used in the oxide type cathode can be adopted. The dispenser cathode of the present invention is suitable for obtaining a high luminance and a high resolving power when used on an ultra-large cathode ray tube or HD television receiver. Further, the dispenser cathode of the present invention can be manufactured without carrying out the process of the complicated impregnation, with the result that manufacturing costs can be saved, and that high quality can be obtained in mass production, compared with the conventional impregnation type cathode.

What is claimed is:

1. A cavity reservoir type dispenser cathode comprising:

a first pellet obtained by forming and sintering a mixture of $Sc_2O_3$ and at least one metal powder selected among W, Mo, Ta, and alloys thereof and at least one metal power selected from Os, Ir, Ru, Re, and alloys thereof;

a second pellet obtained by forming a mixture of barium calcium aluminate and $In_2O_3$;

a cup in which said first and second pellets are received; and a sleeve for supporting said cup.

2. The cavity reservoir type dispenser cathode as claimed in claim 1 wherein said first pellet contains 1–16 wt % $Sc_2O_3$.

3. The cavity reservoir type dispenser cathode as claimed in claim 1 wherein said second pellet contains 20–50 wt % $In_2O_3$.

4. A manufacturing method for a cavity reservoir type dispenser cathode comprising:

forming a first porous pellet by pulverizing at least one metal selected from among Os, Ir, Ru, Re, and alloys thereof into particles having diameters of 2–3 μm, pulverizing at least one metal selected from among W, Mo, Ta, and alloys thereof into particles having diameters of 3–8 μm, mixing the two powders with $Sc_2O_3$, press-forming the mixture, baking the mixture in a vacuum, and heating and sintering the mixture in an atmosphere of hydrogen or in a vacuum;

forming a second pellet by mixing barium calcium aluminate with $In_2O_3$ and press-forming the mixture using a water-soluble binder; and inserting said first and second pellets into a cup and welding said cup to a sleeve.

* * * * *

UNITED STATES PATENT AND TRADEMARK OFFICE

CERTIFICATE OF CORRECTION

PATENT NO. : 4,982,133

DATED : January 1, 1991

INVENTOR(S) : Jong-seo Choi

It is certified that error appears in the above-identified patent and that said Letters Patent is hereby corrected as shown below:

ON THE TITLE PAGE:

In item [73] Assignee, change "Device" to --Devices--.

Column 4, line 65, change "power" to --powder--.

Signed and Sealed this

Thirtieth Day of June, 1992

*Attest:*

DOUGLAS B. COMER

*Attesting Officer*

*Acting Commissioner of Patents and Trademarks*